US007866771B2

(12) United States Patent
Daino et al.

(10) Patent No.: US 7,866,771 B2
(45) Date of Patent: Jan. 11, 2011

(54) DRAWER SLIDE

(75) Inventors: Franco F. Daino, Muskego, WI (US); Michael Edward Hay, Buckingham, IA (US); Jerry Smith, Littleton, CO (US)

(73) Assignee: Master Lock Company LLC, Oak Creek, WI (US)

( * ) Notice: Subject to any disclaimer, the term of this patent is extended or adjusted under 35 U.S.C. 154(b) by 600 days.

(21) Appl. No.: 11/948,450

(22) Filed: Nov. 30, 2007

(65) Prior Publication Data

US 2008/0129169 A1 Jun. 5, 2008

Related U.S. Application Data

(60) Provisional application No. 60/861,878, filed on Nov. 30, 2006.

(51) Int. Cl.
*A47B 88/00* (2006.01)

(52) U.S. Cl. ..... 312/334.16

(58) Field of Classification Search ..... 384/18; 312/334.16, 334.17, 334.25, 334.26, 334.33, 312/334.38, 334.45, 334.7–334.9, 334.11, 312/334.1

See application file for complete search history.

(56) References Cited

U.S. PATENT DOCUMENTS

| | | | | | |
|---|---|---|---|---|---|
| 2,514,664 | A | * | 7/1950 | Miller et al. | 312/334.16 |
| 2,759,773 | A | * | 8/1956 | Reitzel et al. | 384/23 |
| 3,119,644 | A | | 1/1964 | Workman | |
| 3,320,003 | A | * | 5/1967 | Edelson et al. | 384/35 |
| 3,679,274 | A | * | 7/1972 | Nance | 384/21 |
| 3,813,132 | A | | 5/1974 | Sahm | |
| 3,838,048 | A | | 9/1974 | Hedge et al. | |
| 3,934,616 | A | | 1/1976 | Bourges | |
| 3,975,063 | A | * | 8/1976 | Mahotka et al. | 384/18 |
| 4,089,568 | A | * | 5/1978 | Fall | 384/18 |
| 4,475,778 | A | | 10/1984 | Stark | |
| 4,712,927 | A | | 12/1987 | Arrendiell et al. | |
| 4,749,242 | A | | 6/1988 | Rechberg | |
| 5,316,389 | A | | 5/1994 | Hoffman | |
| 5,403,097 | A | | 4/1995 | Woof | |
| 5,421,653 | A | | 6/1995 | Triplette | |
| 5,472,272 | A | | 12/1995 | Hoffman | |
| 5,507,571 | A | | 4/1996 | Hoffman | |
| 5,549,377 | A | | 8/1996 | Krivec | |
| 5,575,564 | A | * | 11/1996 | Harmon et al. | 384/34 |

(Continued)

FOREIGN PATENT DOCUMENTS

| | | | |
|---|---|---|---|
| CA | 2437147 | * | 2/2005 |

OTHER PUBLICATIONS

International Search Report and Written Opinion of the International Searching Authority from International Application No. PCT/US07/86084, maled Jun. 2, 2008.

*Primary Examiner*—Janet M Wilkens
(74) *Attorney, Agent, or Firm*—Calfee, Halter & Griswold LLP

(57) ABSTRACT

A drawer slide mechanism includes at least first and second slide members, with the second slide member being telescopically and movably received by the first slide member in an axial direction. First and second elongated bearing members are disposed laterally between, and in non-rolling sliding engagement with, corresponding inner surfaces of the first slide member and outer surfaces of the second slide member. The first and second elongated bearing members are configured to slide independently of each other.

15 Claims, 6 Drawing Sheets

U.S. PATENT DOCUMENTS

| | | | | |
|---|---|---|---|---|
| 5,626,405 | A | 5/1997 | Banks | |
| 5,775,786 | A | 7/1998 | Liebertz | |
| 5,851,059 | A * | 12/1998 | Cirocco | 312/334.11 |
| 5,868,479 | A | 2/1999 | Hoffman | |
| 5,938,340 | A * | 8/1999 | Brodersen | 384/40 |
| 6,033,047 | A | 3/2000 | Hoffman | |
| 6,224,177 | B1 | 5/2001 | Chu | |
| 6,284,322 | B1 | 9/2001 | Nazaryan et al. | |
| 6,378,968 | B1 * | 4/2002 | Weng | 312/334.11 |
| 6,379,045 | B1 * | 4/2002 | Cirocco | 384/18 |
| 6,705,689 | B2 * | 3/2004 | Chen et al. | 312/334.46 |
| 6,984,008 | B2 | 1/2006 | Milligan | |
| 7,025,430 | B2 | 4/2006 | Lauchner | |
| 7,370,920 | B2 * | 5/2008 | Wang et al. | 312/334.11 |
| 2003/0116937 | A1 | 6/2003 | Blythe | |
| 2005/0218761 | A1 | 10/2005 | Chi | |
| 2006/0066190 | A1 | 3/2006 | Hay | |

* cited by examiner

DRAWER SLIDE

CROSS-REFERENCE TO RELATED APPLICATION

This application claims the benefit of U.S. Provisional Patent Application Ser. No. 60/861,878, entitled "DRAWER SLIDE" and filed Nov. 30, 2006, the entire contents of which are incorporated herein by reference, to the extent that they are not conflicting with the present application.

BACKGROUND

Drawers used with units such as cabinets, chests, and various appliances often utilize telescoping slides to guide the drawer in extending or retracting directions, for example, to access the contents of the drawer and then return the drawer to a stored position within the unit. A slide may reduce resistance in moving the drawer, for example, through the use of rollers or ball bearings received in aligned tracks assembled with the drawer and unit. This type of drawer slide arrangement relies on rolling of the ball bearings or rollers to reduce friction forces experienced by the sliding drawer. However, to provide sufficient support and reduced friction between the aligned tracks, a linear arrangement of many ball bearings or rollers may be required. To facilitate rolling of the ball bearings, lubrication may be required, which may add cost and time to the assembly process and may contaminate or degrade other portions of the cabinet during assembly and use. Further, to reduce wear of the ball bearings, for example, from metal to metal contact, these ball bearings may need to be hardened or otherwise treated to eliminate worn or flat spots on the balls that affect their ability to roll, and in turn, reduce friction. The resulting quantity of components and types of manufacturing operations required may result in added cost to the drawer slide.

SUMMARY

The present application contemplates a drawer slide assembly utilizing non-rolling sliding bearing components, for example, to reduce the number and cost of components utilized and to improve assembly efficiency.

Accordingly, in one exemplary embodiment, a drawer slide mechanism includes at least first and second slide members, with the second slide member being telescopically and movably received by the first slide member in an axial direction. First and second elongated bearing members are disposed laterally between, and in non-rolling sliding engagement with, corresponding inner surfaces of the first slide member and outer surfaces of the second slide member. The first and second elongated bearing members are configured to slide independently of each other.

BRIEF DESCRIPTION OF THE DRAWINGS

Features and advantages of the invention will become apparent from the following detailed description made with reference to the accompanying drawings, wherein.

DETAILED DESCRIPTION

This Detailed Description merely describes embodiments of the invention and is not intended to limit the scope of the claims in any way. Indeed, the invention as claimed is broader than and unlimited by the embodiments described herein, and the terms used have their full ordinary meaning.

According to an inventive aspect of the present application, a drawer slide assembly for slideably connecting a drawer with a unit, such as, for example, a cabinet, chest, or appliance, includes a drawer slide member attached to the drawer and a unit slide member attached with the unit. The slide members may be attached to the drawer and unit using any suitable arrangement, including, for example, by an adhesive, screws, or other such fasteners.

Figure 1:
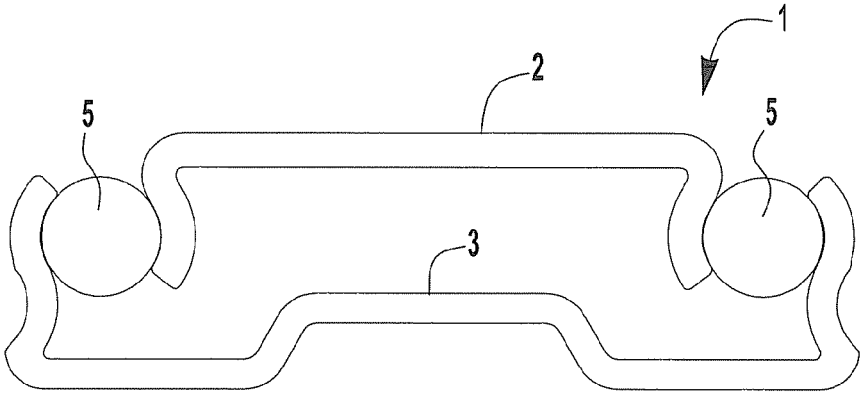
FIG. 1 illustrates a cross-sectional view of a drawer slide assembly.

To facilitate movement of the drawer and unit slide members with respect to each other, one or more low friction bearing members may be positioned between the slide members. In one embodiment, a low friction bearing member may be disposed directly between the drawer and unit slide members for sliding movement of the drawer slide member with respect to the unit slide member. The bearing member prevents contact between the adjacent slide members, and, in the case of metal slide members, may prevent binding and galling often associated with metal to metal contact. The reduced friction of these sliding surfaces may facilitate smoother, quieter, and more effortless movement of the drawer between extended and retracted positions. In one example, a bearing member may include an intermediate or center slide member having low friction bearing surfaces positioned to be in sliding engagement with the drawer and unit slide members. In another example, as illustrated in FIG. 1, a drawer slide assembly 1 may include two or more bearing members 5 disposed between a drawer slide member 2 and a unit slide members 3 for sliding movement of the drawer slide member 2 with respect to the unit slide member 3. The first and second bearing members 5 of the illustrated embodiment may be configured to be in non-rolling sliding engagement with corresponding first and second inner surfaces of the unit slide member 3 and with corresponding first and second outer surfaces of the drawer slide member 2, such that the bearing members 5 may slide independent of each other to facilitate sliding movement of the drawer slide member 2.

In another embodiment, a drawer slide mechanism may include three rails or slide members—a first slide member for attachment to one of a drawer and a storage unit; a second slide member telescopically received by (or receiving) the first slide member and axially slideable with respect to the first slide member; and a third slide member telescopically received by (or receiving) the second slide member and axially slideable with respect to the second slide member for attachment to the other of the drawer and storage unit, the third slide member being configured to be attached to the other of the drawer and the storage unit. Use of three telescoping slide members may, for example, allow for extended sliding movement of a drawer with respect to a storage unit, while providing sufficient support and stability for the drawer and its contents. In one embodiment, one or more bearing members may be disposed between the first and second slide members for sliding movement of the second slide member with respect to the first slide member. Further, one or more bearing members may be disposed between the second and third slide members for sliding movement of the third slide member with respect to the second slide member.

Many different low friction materials may be utilized as bearing members, including, for example, low friction plastics such as nylon, acetal resin (DELRIN®), or ultra high molecular weight polyethylene (UHMWPE). Further, a material may be impregnated with a lubricant to further reduce friction; one example of such a material is nylon 6/6 impregnated with molybdenum disulfide. By using a low friction bearing member, a rolling mechanism, as is used with a ball bearing or roller type assembly, may not be required, as the low friction intermediary bearing members facilitate freely sliding movement of the slide members with respect to each other.

Many different types of bearing members may be utilized between the slide members of a drawer slide assembly. According to one inventive aspect of the present application, one or more elongated bearing members may be disposed between contoured surfaces of slide members, providing bands of contact between the low friction bearing members and the adjacent slide members, as compared to the more focused point contact of a ball bearing. While these bearing members may be provided in may different shapes (e.g., rectangular in cross section), in one embodiment, the bearing members may be cylindrical, or substantially circular in cross section, for sliding engagement with corresponding arcuate surfaces of the adjacent slide members. In one example, a bearing member may be a cylindrical rod sized to replace a conventional set of ball bearings in a conventional drawer slide assembly. A greater distribution of contact force resulting from this band of contact may further reduce resistance during operation of the drawer.

Figure 2:
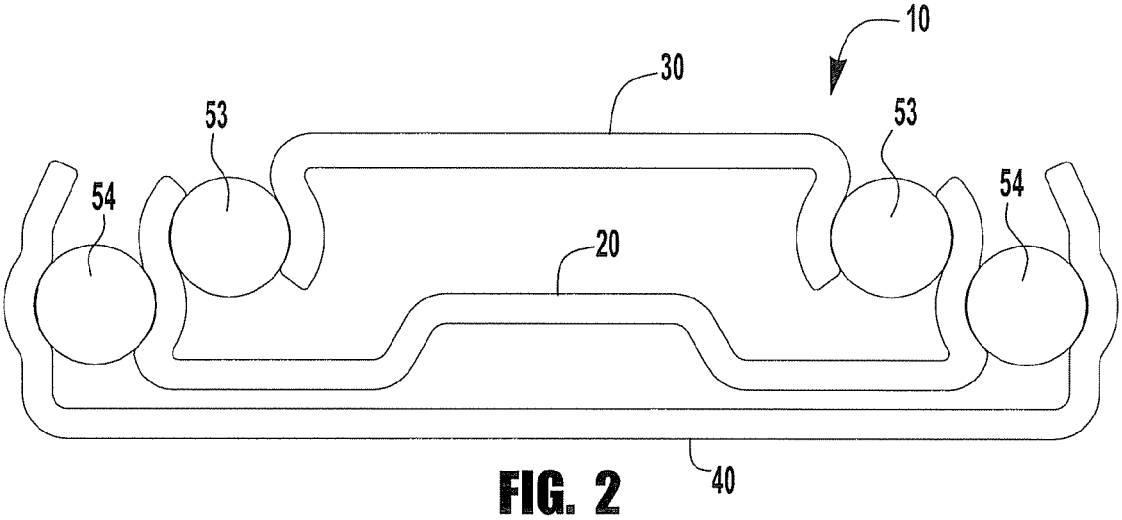
FIG. 2 illustrates a cross-sectional view of another drawer slide assembly.
Figure 3:
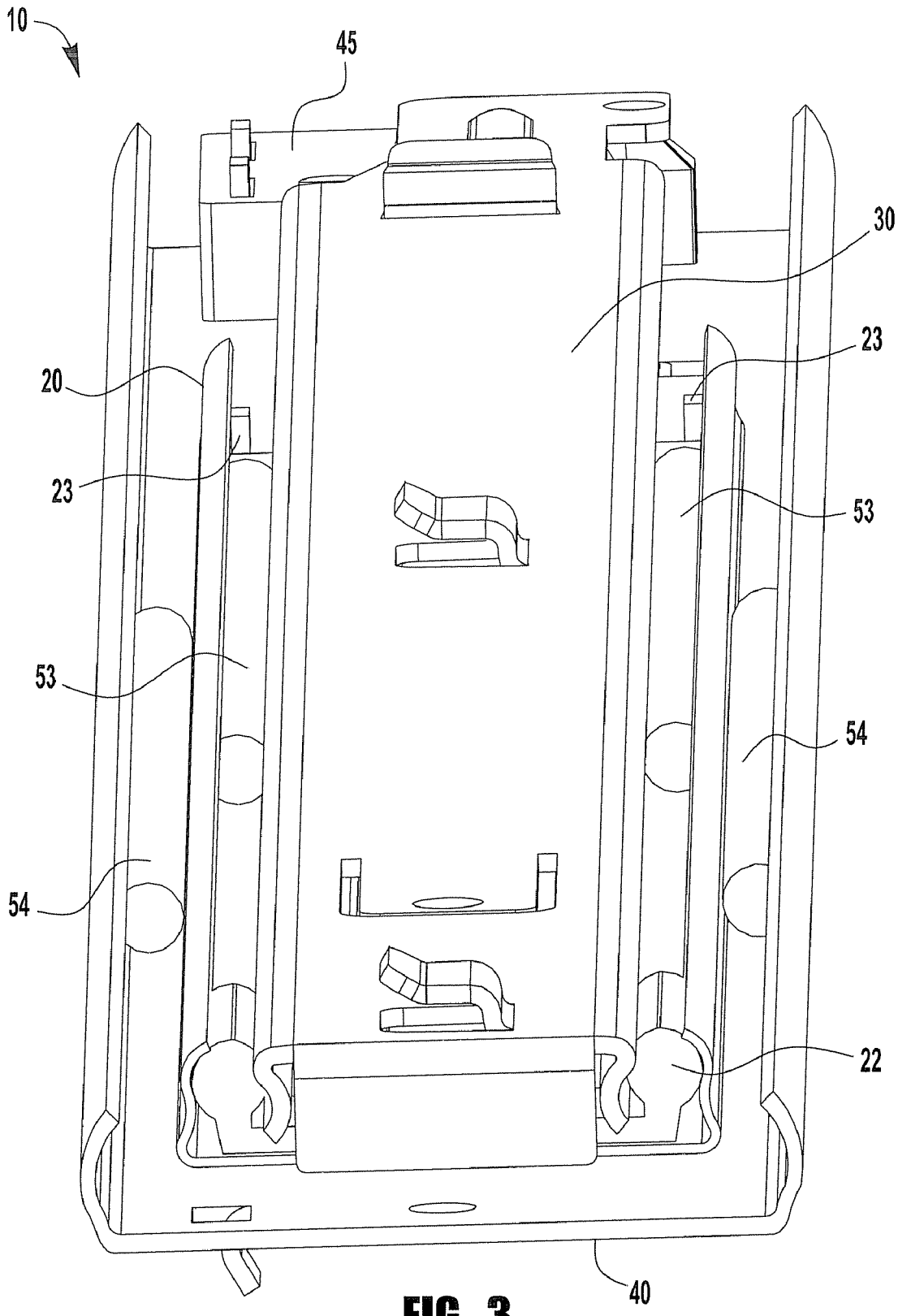
FIG. 3 illustrates a perspective view of the drawer slide assembly of FIG. 2.

FIGS. 2 and 3 illustrate an exemplary drawer slide assembly 10, in which a center slide member 20 is assembled with a drawer slide member 30 and a unit slide member 40 to facilitate sliding movement of the drawer slide member 30 with respect to the unit slide member 40 when a drawer (not shown) is extended from or retracted into a unit (not shown). While an exemplary unit includes one drawer slide assembly 10 for each side of the drawer, in another embodiment, either or both sides of the drawer may employ multiple drawer slide assemblies. Also, as with all of the "unit" and "drawer" slide members described herein, while slide member 40 is attached to a unit and slide member 30 is attached to a drawer in an exemplary embodiment, in another embodiment, slide member 40 may be attached to a drawer and slide member 30 may be attached to a unit.

Disposed between the center slide member 20 and the drawer and unit slide members 30, 40 are rod shaped bearing members 53, 54, which may be provided in a low friction material, such as nylon. The bearing members 53, 54 may be configured to travel with the center slide member 20 as the drawer slide member 30 is moved with respect to the unit slide member 40. This may be accomplished, for example, by staking the bearing members 50 into engagement with the center slide member 20. In another embodiment, each of the bearing members 53, 54 may be configured to independently slide with respect to the adjacent slide members 20, 30, 40 along a range of axial movement. Axial movement of the bearing members 53, 54 may be limited, for example, by protrusions, tabs, or other stops on the slide members 20, 30, 40 to engage the bearing members 53, 54 at desired limit positions. Likewise, stops may be provided on the slide members 20, 30, 40 to limit the range of movement of the adjacent slide member or members. In one embodiment, the center slide member 20 may be permitted to extend approximately half way out of the unit when the drawer is extended from the unit. For example, as shown in FIG. 3, movement of the inner bearing members 53 may be limited in a first direction by an insert 22 affixed to the center slide member 20 (e.g., by an adhesive or rivets), and in a second direction by inward extending tabs 23 on the center slide member 20. As shown, a drawer latch 45 may be provided at an inner end of the unit slide member 40 for releasably retaining the drawer slide member 30 when the drawer slide member is axially moved to a fully retracted position. While many different types of drawer latches may be used, one example of a drawer latch is described in U.S. Pat. No. 6,224,177, the entire disclosure of which is incorporated by reference herein, to the extent it is not conflicting with the present application.

According to another inventive aspect of the present application, a drawer slide assembly may further include slide members with low friction surfaces for slideably engaging low friction bearing members, for even further reduced friction between the slide members during operation of the drawer slide assemblies. While the slide members may be constructed from a lower friction material, in another embodiment, a low friction coating (e.g., nylon) may be applied to the bearing member engaging surfaces of the slide members for reduced friction. The contours and shapes of these bearing member engaging surfaces of the slide members may be varied, for example, to take into consideration area of surface contact with low friction coatings, manufacturability of the slide members, durability of the coatings and/or slide members, size restrictions, and adequate strength and support of the drawer (and its contents) during operation of the drawer slide assemblies, and other such factors.

Many different methods may be used to adhere the bearing coatings to the slide members. As one example, a thin adhesive coating, such as, for example, SANTOPRENE®, may be applied to the slide member to facilitate adhesion of the low friction coating to the slide member. In one embodiment, a coated slide member may be formed using a combined process in which the metal (e.g., steel) slide member is roll formed into an extruder to combine with an extruded thermoplastic coating, a process known in the art as ROLLTRUSION™.

Figure 4:
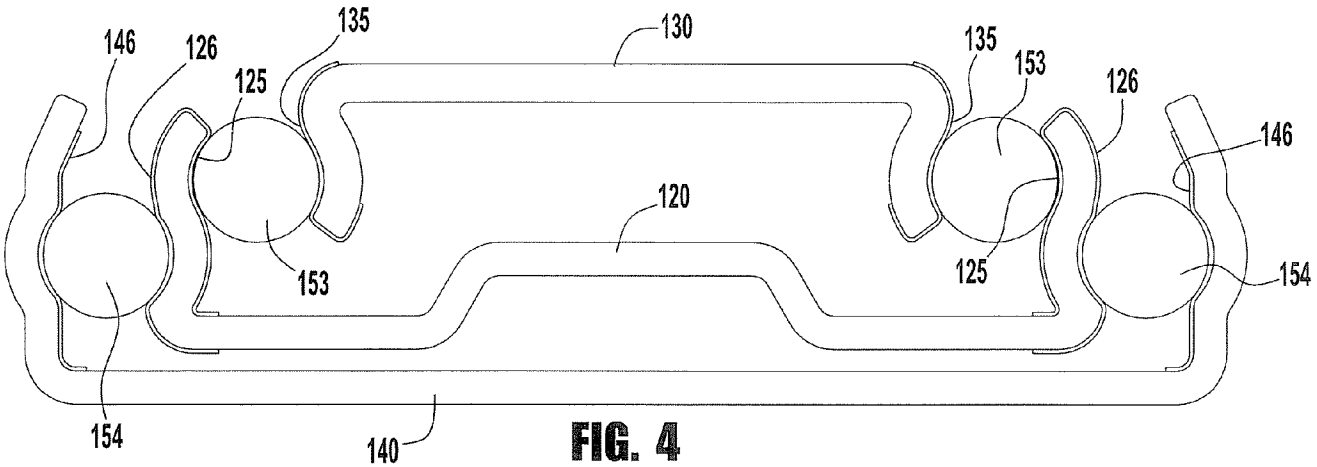
FIG. 4 illustrates a cross-sectional view of another drawer slide assembly.

FIG. 4 illustrates an exemplary drawer slide assembly having a center slide member 120, drawer slide member 130, and unit slide member 140, which may be consistent in shape with the slide members 20, 30, 40 of the embodiment of FIG. 1. The slide members are assembled with bearing members 153, 154 disposed between corresponding coated surfaces 125, 126, 135, 146 of the slide members 120, 130, 140.

Figure 5:
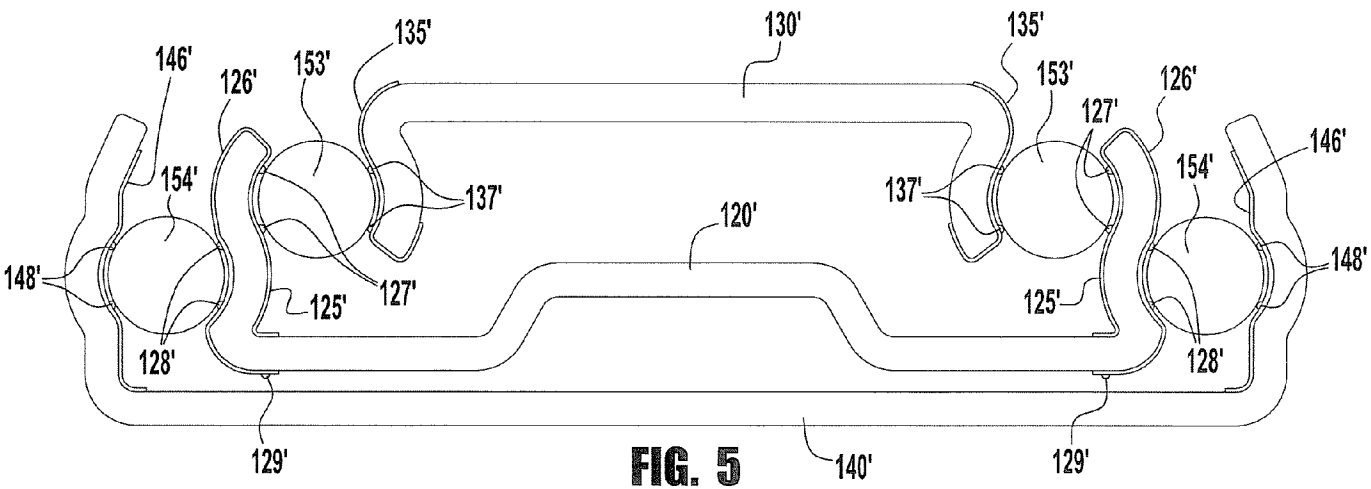
FIG. 5 illustrates a cross-sectional view of still another drawer slide assembly.

In another embodiment, bearing member engaging surfaces of the slide members may be configured to reduce the contact surface areas between the slide members and the bearing members, which may further reduce friction. While many different arrangements may be utilized to reduce these contact surface areas, in one embodiment, as shown in FIG. 5, the coated surfaces 125', 126', 135', 146' may include one or more axially extending ribs 127', 128', 137', 148' or other protrusions positioned to engage the bearing members 153', 154'. Additional ribs 129' may also be provided on the center slide member 120' to prevent rubbing or binding of the center slide member 120' against the unit slide member 140'.

While bearing members or coated bearing surfaces may be provided in a compressible material to accommodate dimensional variances in the slide members of a drawer slide assembly, reduced contact surface areas may also reduce friction resulting from these variances. According to another inventive aspect of the present application, contact surface areas between slide members and bearing member of a drawer slide assembly may be reduced by providing a bearing member with a plurality of axially spaced bearing portions separated by web portions that are spaced apart from the bearing member engaging surfaces of the slide members. The bearing portions may be provided in any suitable shape or contour, including, for example, cylindrical or spherical portions. Further the web portions may be provided in a material or thickness configured to allow bending or flexure of the flexible web portions, thereby allowing for independent lateral movement of each of the bearing portions with respect to the other bearing portions.

Figure 6:
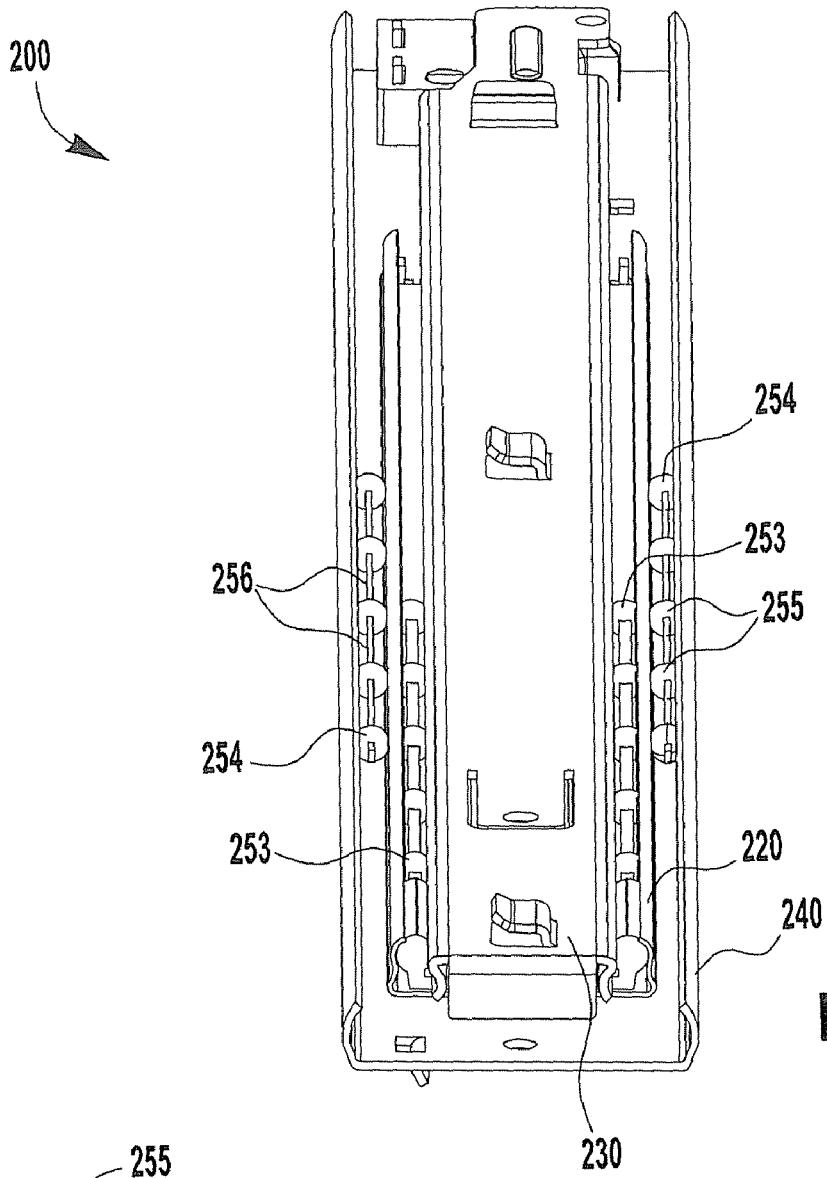
FIG. 6 illustrates a perspective view of yet another drawer slide assembly.
Figure 7:
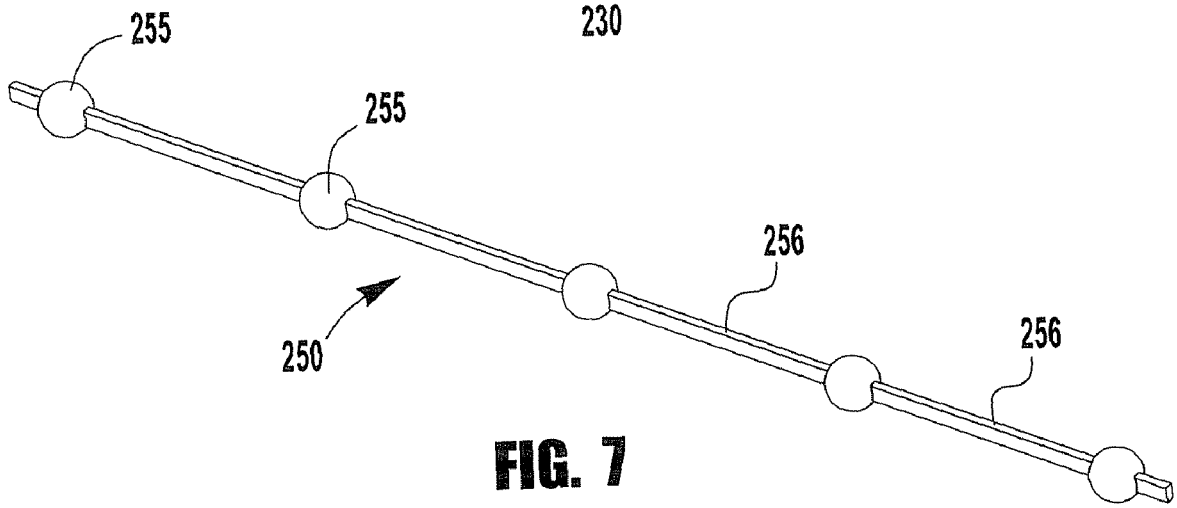
FIG. 7 illustrates a perspective view of a bearing member of the drawer slide assembly of FIG. 6.

FIG. 6 illustrates an exemplary drawer slide assembly 200 having center, drawer, and unit slide members 220, 230, 240 assembled with bearing members 253, 254 having bearing portions 255 axially spaced by web portions 256. While the web portions 256 are shown as being rectangular in cross section (see FIG. 7), the web portions may be provided in any size or shape sufficient to maintain spacing from the bearing member engaging surfaces of the slide members, and to permit bending or flexure of the web portions 256 for independent lateral movement of each of the bearing portions. To further reduce friction, one or more of the slide members 220, 230, 240 may be provided with surfaces coated with a low-function material, as shown in the embodiments of FIGS. 4 and 5.

According to another inventive aspect of the present application, a center slide member may be adapted to function as a bearing member, thereby eliminating the need for additional bearing members (e.g., ball bearings or other rolling or sliding components) between the drawer and unit slide members. In one embodiment, points of engagement between a center slide member and drawer and unit slide members may include low friction coatings, such as those described above, on one or more of the slide members to reduce friction between adjacent slide members during operation of the drawer slide assemblies. As one example, a slide member may be provided with low friction material coatings on a first side for sliding engagement with the drawer slide member, and low friction material coatings on a second side for sliding engagement with the unit slide member. These coatings may be positioned to eliminate rubbing or binding of the adjacent slide members, as well as to center each slide member with respect to the other slide members, and to minimize pivoting or rotation of each slide member with respect to the other slide members. Further, the corresponding contours and shapes of the slide members may be varied, for example, to take into consideration area of surface contact with low friction coatings, manufacturability of the slide members, durability of the coatings and/or slide members, size restrictions, and adequate strength and support of the drawer (and its contents) during operation of the drawer slide assemblies, and other such factors.

Figure 8:
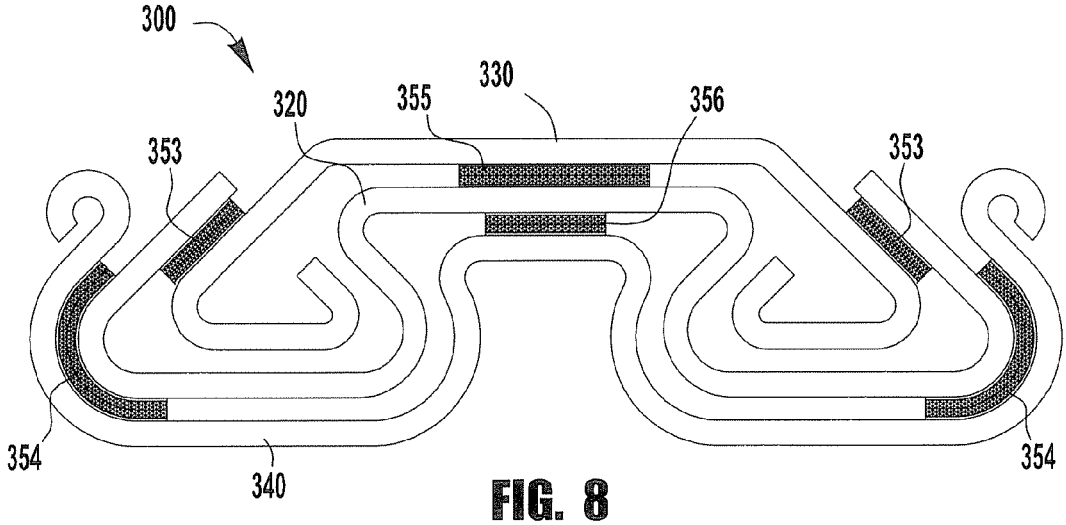
FIG. 8 illustrates a cross-sectional view of another drawer slide assembly.
Figure 9:
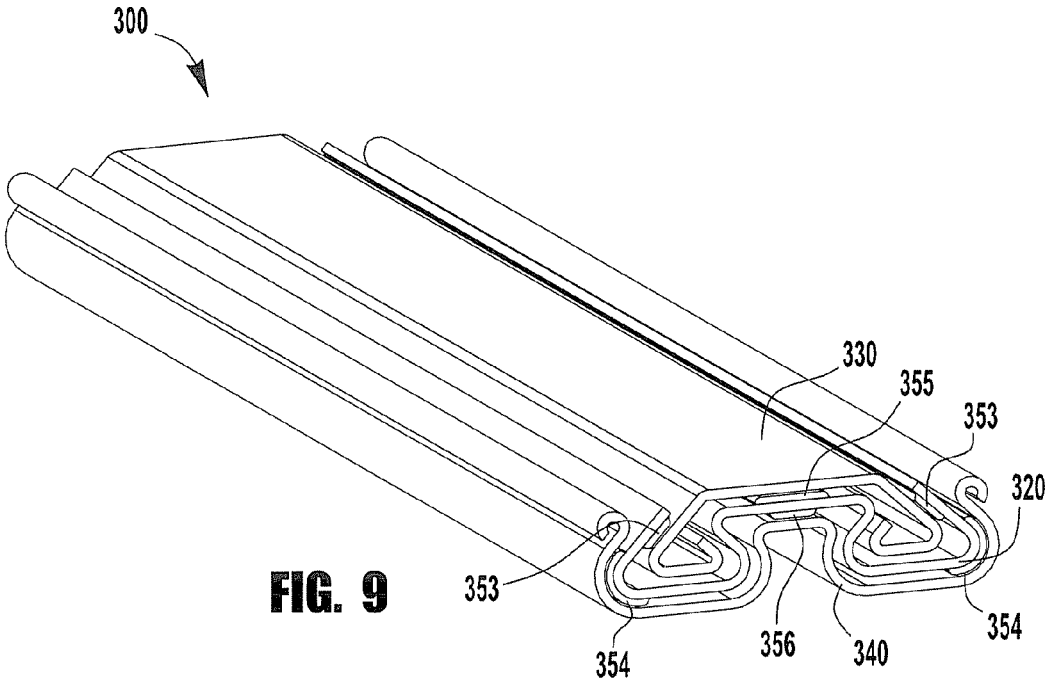
FIG. 9 illustrates a perspective view of the drawer slide assembly of FIG. 8.

FIGS. 8 and 9 illustrate an exemplary drawer slide assembly 300 utilizing a center slide member 320 having low friction coated bearing surfaces 353, 354, 355, 356 as a bearing member between a drawer slide member 330 and a unit slide members 340. The center slide member 320 is telescopically and movably received by the unit slide member 340, and the drawer slide member 330 is telescopically and movably received by the center slide member 320. While the coated bearing surfaces 353, 354, 355, 356 of the exemplary embodiment are adhered to the center slide member 320, in other embodiments, low friction coatings may additionally or alternatively be applied to the drawer and unit slide members 330, 340. As shown, the edges of the drawer slide member 330 and unit slide member 340 may be hemmed or otherwise contoured to prevent gouging or scraping of the adjacent coated bearing surfaces 353, 354.

The exemplary center slide member 320 includes laterally outer bearing surfaces 353, 354 positioned to be in sliding engagement with laterally outer portions of the drawer and unit slide members 330, 340. As shown, the outer bearing surfaces 353, 354 may be laterally spaced from a lateral center line of the slide members 320, 330, 340 by a non-bearing portion of the center slide member 320. These outer bearing portions 353, 354 may face partially laterally (i.e., across each slide member), for example, to facilitate centering of the slide members 320, 330, 340 with respect to each other, and partially radially (i.e., between the slide members), for example, to prevent contact between adjacent slide members 320, 330, 340.

The exemplary center slide member 320 also includes laterally central bearing surfaces 355, 356 positioned to be in sliding engagement with laterally central portions of the drawer and unit slide members 330, 340. As shown, the central bearing surfaces 355, 356 may be positioned along a lateral center line of the slide members 320, 330, 340. These central bearing surfaces 355, 356 face radially, for example, to resist contact between the adjacent slide members 320, 330, 340. In other embodiments, central bearing surfaces may face at least partially laterally to facilitate centering of the slide members with respect to each other.

Figure 10:
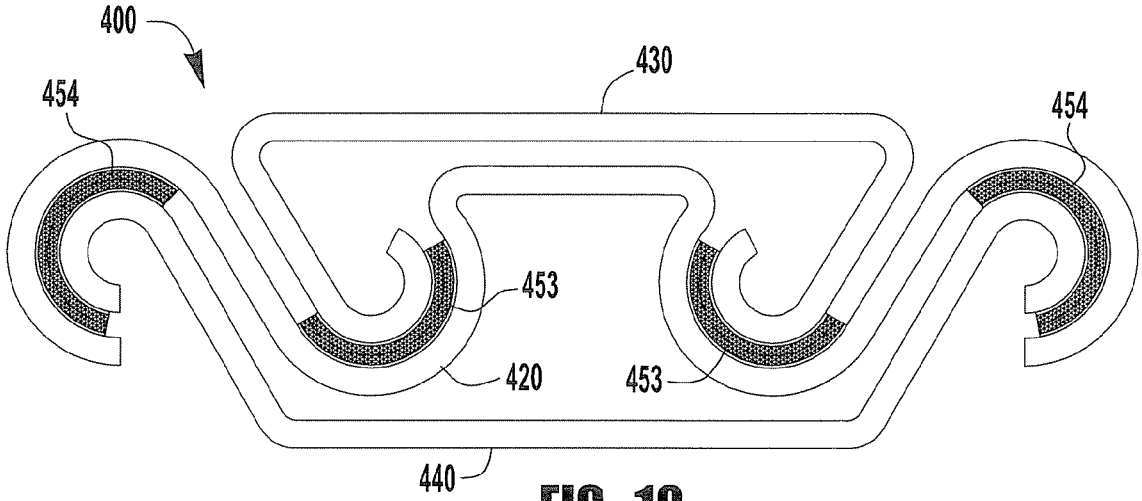
FIG. 10 illustrates a cross-sectional view of still another drawer slide assembly.

FIG. 10 illustrates another exemplary drawer slide assembly 400 utilizing a center slide member 420 having low friction coated bearing surfaces 453, 454 as a bearing member between a drawer slide member 430 and a unit slide members 440. The exemplary center slide member 420 telescopically and movably receives both the unit slide member 340 and the drawer slide member 430. While the coated bearing surfaces 453, 454 of the exemplary embodiment are adhered to the center slide member 420, in other embodiments, low friction coatings may additionally or alternatively be applied to the drawer and unit slide members 430, 440.

The exemplary center slide member 420 includes laterally outer bearing surfaces 453, 454 positioned to be in sliding engagement with laterally outer portions of the drawer and unit slide members 430, 440. As shown, the outer bearing surfaces 453, 454 may be laterally spaced from a lateral center line of the slide members 420, 430, 440 by a non-bearing portion of the center slide member 420. Further, the bearing surfaces 453 for engaging the drawer slide member 430 may be laterally spaced from the bearing surfaces 454 for engaging the unit slide member by non-bearing portions of the center slide member 420. These outer bearing portions 453, 454 may face partially laterally (across each slide member), for example, to facilitate centering of the slide members 420, 430, 440 with respect to each other, and partially radially (between the slide members), for example, to resist contact between adjacent slide members 420, 430, 440.

Figure 11:
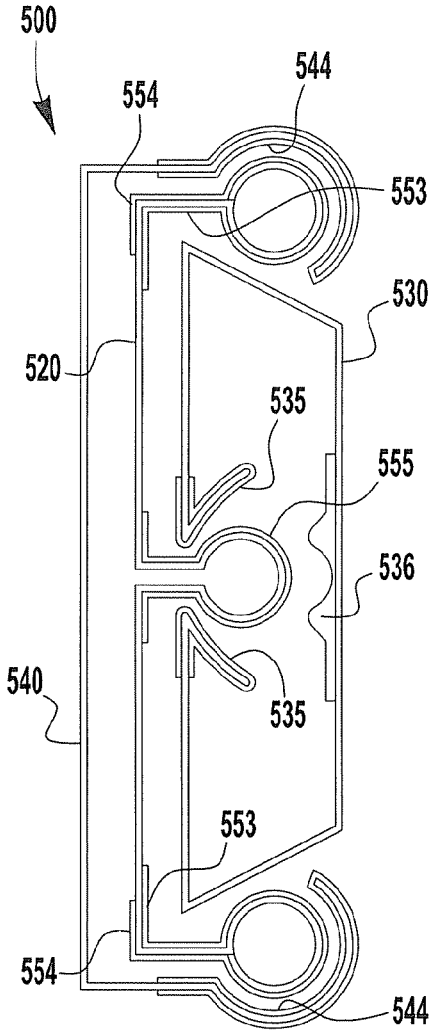
FIG. 11 illustrates a cross-sectional schematic view of yet another drawer slide assembly.

FIG. 11 illustrates another exemplary drawer slide assembly 500 utilizing a center slide member 520 having low friction coated bearing surfaces 553, 554, 555 as a bearing member between a drawer slide member 530 and a unit slide members 540. The center slide member 520 is telescopically and movably received by the unit slide member 540, and the drawer slide member 530 is telescopically and movably received by the center slide member 520.

The exemplary center slide member 520 includes laterally outer bearing surfaces 553, 554 positioned to be in sliding engagement with laterally outer portions of the drawer and unit slide members 530, 540. As shown, the outer bearing surfaces 553, 554 may be laterally spaced from a lateral center line of the slide members 520, 530, 540 by a non-bearing portion of the center slide member 520. These outer bearing portions 553, 554 may face partially laterally (across each slide member), for example, to facilitate centering of the slide members 520, 530, 540 with respect to each other, and partially radially (between the slide members), for example, to resist contact between adjacent slide members 520, 530, 540. As shown, the unit slide member 540 may be provided with corresponding low friction coated surfaces 544 positioned to engage the outer bearing surfaces 554.

The exemplary center slide member 520 also includes a laterally central bearing surface 555 positioned to be in sliding engagement with a laterally central portion of the drawer slide member 530. As shown, the central bearing surface 555 may be positioned along a lateral center line of the slide members 520, 530, 540. The central bearing surface 555 may face partially laterally (across each slide member), for example, to facilitate centering of the slide members 520, 530 with respect to each other, and partially radially (between the slide members), for example, to resist contact between adjacent slide members 520, 530. As shown, the drawer slide member 530 may be provided with corresponding low friction coated surfaces 535, 536 positioned to engage the central bearing surfaces 555.

Figure 12:
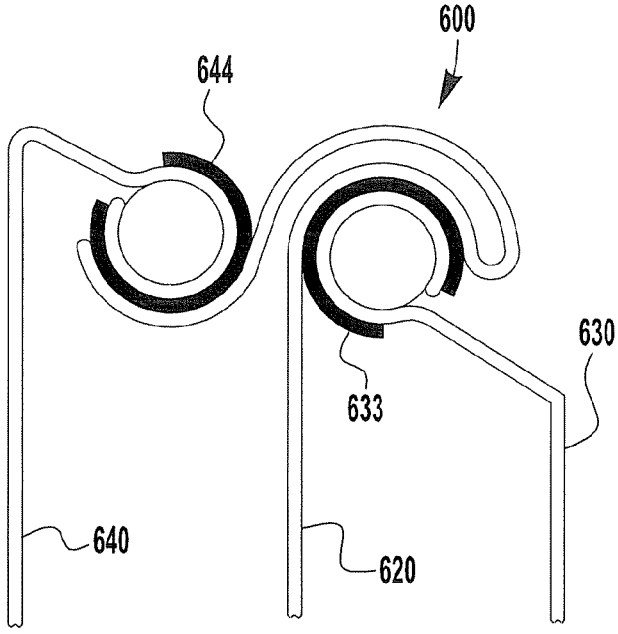
FIG. 12 illustrates a cross-sectional partial schematic view of another drawer slide assembly.

FIG. 12 illustrates a partial view of one end of another exemplary drawer slide assembly 600 utilizing a center slide member 620 as a bearing member between a drawer slide member 630 and a unit slide members 640. The center slide member 620 is telescopically and movably received by the unit slide member 640, and the drawer slide member 630 is telescopically and movably received by the center slide member 620. While coated bearing surfaces 633, 644 of the exemplary embodiment are adhered to the drawer and unit slide members 630, 640, in other embodiments, low friction coatings may additionally or alternatively be applied to the center slide member 620.

The exemplary drawer and unit slide members 630, 640 include laterally outer bearing surfaces 633, 644 positioned to be in sliding engagement with laterally outer portions of the center slide member 620. As shown, the outer bearing surfaces 633, 644 may be laterally spaced from a lateral center line of the slide members 620, 630, 640 by a non-bearing portion of the center slide member 620. The arcuate outer bearing portions 633, 644 face partially laterally (across each slide member), for example, to facilitate centering of the slide members 620, 630, 640 with respect to each other, and partially radially (between the slide members), for example, to resist contact between adjacent slide members 620, 630, 640.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A drawer slide mechanism comprising:

at least first and second slide members, the second slide member being telescopically and movably received by the first slide member in an axial direction;

a first elongated bearing member disposed laterally between, and in non-rolling sliding engagement with, a first inner surface of the first slide member and a first outer surface of the second slide member; and a second elongated bearing member disposed laterally between, and in non-rolling sliding engagement with, a second inner surface of the first slide member and a second outer surface of the second slide member;

wherein the first and second elongated bearing members are configured to slide independently of each other.

2. The drawer slide mechanism of claim 1, wherein at least one of the first and second elongated bearing members comprises a bearing surface that is substantially circular in cross section.

3. The drawer slide mechanism of claim 1, wherein at least one of the first and second elongated bearing members comprises a cylindrical rod constructed from a low friction material.

4. The drawer slide mechanism of claim 1, wherein at least one of the first and second bearing members comprises a plurality of axially spaced bearing portions and at least one web portion connecting adjacent bearing portions, the at least one web portion being spaced apart from the first inner surface of the first slide member and the first outer surface of the second slide member.

5. The drawer slide mechanism of claim 4, wherein the at least one web portion is flexible to permit independent lateral movement of each of the plurality of bearing portions with respect to the others of the plurality of bearing portions.

6. The drawer slide mechanism of claim 4, wherein each of the plurality of bearing portions is substantially spherical.

7. The drawer slide mechanism of claim 1, wherein at least one of the first and second inner surfaces of the first slide member and the first and second outer surfaces of the second slide member comprises a low friction material coating.

8. The drawer slide mechanism of claim 7, wherein the low friction material coating comprises at least one axially extending rib for engaging the corresponding elongated bearing member.

9. The drawer slide mechanism of claim 1, wherein at least one of the first and second elongated bearing members comprises a bearing surface coated with a low friction material.

10. A drawer slide mechanism comprising:

a first slide member;

a second slide member telescopically and movably received by the first slide member in an axial direction;

a third slide member telescopically and movably received by the second slide member in an axial direction;

a first elongated bearing member disposed laterally between, and in non-rolling sliding engagement with, a first inner surface of the first slide member and a first outer surface of the second slide member;

a second elongated bearing member disposed laterally between, and in non-rolling sliding engagement with, a second inner surface of the first slide member and a second outer surface of the second slide member;

a third elongated bearing member disposed laterally between, and in non-rolling sliding engagement with, a first inner surface of the second slide member and a first outer surface of the third slide member; and a fourth elongated bearing member disposed laterally between, and in non-rolling sliding engagement with, a second inner surface of the second slide member and a second outer surface of the third slide member.

11. The drawer slide mechanism of claim 10, wherein the first, second, third, and fourth bearing members are configured to slide independently of each other.

12. The drawer slide mechanism of claim 10, wherein at least one of the first, second, third, and fourth elongated bearing members comprises a bearing surface that is substantially circular in cross section.

13. The drawer slide mechanism of claim 10, wherein at least one of the first, second, third, and fourth elongated bearing members comprises a plurality of axially spaced bearing portions and at least one web portion connecting adjacent bearing portions.

14. The drawer slide mechanism of claim 13, wherein the at least one web portion is flexible to permit independent lateral movement of each of the plurality of bearing portions with respect to the others of the plurality of bearing portions.

15. The drawer slide mechanism of claim 13, wherein each of the plurality of bearing portions is substantially spherical.

* * * * *